US011970322B2

(12) United States Patent
Nelson et al.

(10) Patent No.: US 11,970,322 B2
(45) Date of Patent: Apr. 30, 2024

(54) SECURING APPARATUS FOR PACKAGING AND SHIPPING

(71) Applicant: Encore Packaging LLC, Lake Villa, IL (US)

(72) Inventors: Timothy H. Nelson, Winnetka, IL (US); Richard Bustard Nelson, Atlanta, GA (US)

(73) Assignee: Encore Packaging LLC, Lake Villa, IL (US)

( * ) Notice: Subject to any disclaimer, the term of this patent is extended or adjusted under 35 U.S.C. 154(b) by 0 days.

(21) Appl. No.: 17/519,934

(22) Filed: Nov. 5, 2021

(65) Prior Publication Data

US 2022/0144518 A1 May 12, 2022

Related U.S. Application Data

(60) Provisional application No. 63/111,014, filed on Nov. 7, 2020.

(51) Int. Cl.
*B65D 71/04* (2006.01)
*B65D 81/05* (2006.01)

(52) U.S. Cl.
CPC ..... *B65D 71/04* (2013.01); *B65D 81/056* (2013.01); *B65D 2571/00117* (2013.01); *B65D 2581/055* (2013.01); *B65D 2581/058* (2013.01)

(58) Field of Classification Search
CPC ..... B65D 71/04; B65D 81/056; B65D 2571/00117; B65D 2581/055; B65D 2581/058; B65D 71/0096
(Continued)

(56) References Cited

U.S. PATENT DOCUMENTS

D37,561 S 9/1905 Clark
D46,799 S 12/1914 Douglass
(Continued)

FOREIGN PATENT DOCUMENTS

GB 2069459 A * 8/1981 ..... B65D 21/0224
WO WO-2005030593 A1 * 4/2005 ..... B65D 21/0224
(Continued)

OTHER PUBLICATIONS

Amazon. Faotup 20PCS 0.98Inch Zinc Alloy Black Box Corner Protectors Metal,Metal Box Corner Protectors Edge Guard,Metal Box Corner Protector,Cabinet Corner Protectors Metal,0.98x0.98x0.98Inches.Jun. 11, 2022. https://amzn.to/3Vzf9sy (Year: 2022).
(Continued)

*Primary Examiner* — J. Gregory Pickett
*Assistant Examiner* — Jenine Pagan
(74) *Attorney, Agent, or Firm* — Fitch, Even, Tabin & Flannery LLP

(57) ABSTRACT

A securing apparatus includes a main body that defines a cavity sized to receive a portion of an object, such as a box's corner. The securing apparatus includes at least one anchor extending from the main body that is configured to engage with the corner portion of the object such that the securing apparatus may be removably coupled thereto. The main body of the securing apparatus may include eyelets configured to receive a length of filament such that multiple objects may be secured to one another during packaging and shipping. Additionally, the securing apparatus may also include a projecting finger that is configured to retain a length of filament that may be used to attach the object more securely to a pallet or other structure for shipping.

14 Claims, 9 Drawing Sheets

(58) Field of Classification Search
USPC ..... 206/597, 509, 595, 596, 598, 511, 512, 206/821, 386
See application file for complete search history.

(56) References Cited

U.S. PATENT DOCUMENTS

| | | | | | |
|---|---|---|---|---|---|
| 2,037,609 | A * | 4/1936 | Luis | B65D 71/04 | 229/199 |
| D141,940 | S | 7/1945 | Ikelheimer | | |
| 2,472,939 | A * | 6/1949 | Connolly | B65D 25/22 | 294/68.1 |
| D214,487 | S | 6/1969 | Reichl et al. | | |
| D223,895 | S | 6/1972 | Berchert | | |
| 3,752,511 | A * | 8/1973 | Racy | B65D 90/0013 | 410/82 |
| 4,127,192 | A | 11/1978 | Card | | |
| D271,070 | S | 10/1983 | Durkee | | |
| D281,484 | S | 11/1985 | Dickes | | |
| 4,787,553 | A * | 11/1988 | Hoskins | B65D 5/006 | 206/821 |
| 4,938,357 | A * | 7/1990 | Schmidt | B60P 7/0869 | 217/69 |
| 5,323,903 | A * | 6/1994 | Bush | B65D 90/24 | 220/571 |
| D356,946 | S | 4/1995 | Rekuc | | |
| 5,431,336 | A * | 7/1995 | Clee | B65D 11/1833 | 229/199 |
| D394,603 | S | 5/1998 | Brandes | | |
| D614,489 | S | 4/2010 | Doster | | |
| D664,851 | S | 8/2012 | Burns | | |
| 8,690,471 | B2 * | 4/2014 | Wians | A47B 47/00 | 211/183 |
| D814,300 | S | 4/2018 | Hägglund | | |
| D814,358 | S | 4/2018 | Norfleet | | |
| 10,654,638 | B2 | 5/2020 | Martin | | |
| 2008/0019788 | A1 * | 1/2008 | Clarke | B65D 71/0096 | 410/116 |
| 2011/0203962 | A1 | 8/2011 | Smith | | |
| 2011/0278199 | A1 * | 11/2011 | Dane | A61L 2/26 | 29/525.01 |
| 2011/0278416 | A1 | 11/2011 | Tao | | |

FOREIGN PATENT DOCUMENTS

| | | | | |
|---|---|---|---|---|
| WO | WO-2009004537 | A1 * | 1/2009 | B60P 7/0869 |
| WO | WO-2009052589 | A1 * | 4/2009 | B65D 19/38 |

OTHER PUBLICATIONS

Amazon. [80 Pack] Shipping Box Corner Protectors Plastic Packaging Edge Protectors , Carton Packing Corner Guard Frame V Corner Protectors 60 Type Handcraft Packaging Protector for Express Box Packaging. Jun. 26, 2021. https://www.amazon.com/Protectors-Packaging-Handcraft-Protector-Packaging/dp/B097ZC21 RJ (Year: 2021) w.

Made in China. Paper Box Corner Protectors Edge Board Corner Guard. No date specified. https://www.made-in-china.com/video-channel/packagingmachinery_LMPEmZKjfyGC_Paper-Box-Corner-Protectors-Edge-Board-Corner-Guard.html (Year: 0).

U.S. Appl. No. 29/757,641, filed Nov. 7, 2020.

* cited by examiner

SECURING APPARATUS FOR PACKAGING AND SHIPPING

CROSS-REFERENCE TO RELATED APPLICATION

This application claims the benefit of U.S. Provisional Application No. 63/111,014, filed Nov. 7, 2020, which is hereby incorporated by reference herein in its entirety.

FIELD

The present disclosure relates generally to the shipping of objects, and more specifically, to a securing apparatus for the packaging and shipping of objects.

BACKGROUND

Storage containers such as boxes are commonly used for packaging, shipping, and delivery of certain goods. To package and ship goods in an efficient manner, it may be desirable to stack various storage containers on a pallet in an organized manner and secure the storage containers thereto using stretch wrap and/or strapping. Manufacturers of such goods recognize that care must be taken in the packaging and shipping of storage containers to avoid damage that may occur as a result of rough handling.

Typically, the manufacturer is required to use a large amount of stretch wrap and/or strapping to ensure that the storage containers are effectively secured on the pallet and will not otherwise fall off or be damaged during shipping. This stretch wrap and strapping can be costly for the manufacturer as the stretch wrap cannot typically be reused and is usually discarded once the objects reach their intended destination. Nevertheless, the manufacturer is incentivized to use a large amount of the stretch wrap and/or strapping or else risk that the goods may fall off the pallet during transit.

Generally, many storage containers used for shipping goods are formed of corrugated cardboard or other similar materials. However, such cardboard boxes can become damaged during shipping by, for example, wear and tear from rough handling or improper stacking on a pallet. In some instances, the edges or corners of the boxes may become easily damaged due to contact with other surfaces or boxes during transit, or if the box is compressed from above by another box stacked on top of it. As a result, the corners of the boxes may split open or the goods inside of the boxes may be inadvertently damaged.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of the various embodiments. For example, the pallet shown in various figures is illustrated as a box-like structure for simplicity, but skilled artisans will appreciate the structure of known pallets or other similar shipping structures. It will further be appreciated that certain actions and/or steps may be described or depicted in a particular order of occurrence while those skilled in the art will understand that such specificity with respect to sequence is not actually required.

DETAILED DESCRIPTION

In accordance with one aspect of the present disclosure, a securing apparatus is configured to assist in securing objects during packaging and shipping. The securing apparatus includes a main body having a plurality of intersecting wall portions that define an at least partially hollow cavity sized to receive a portion of an object, such as a corner of a box. The securing apparatus includes at least one anchor extending from the main body that is positioned at least partially in the cavity and is configured to engage with the portion of the object such that the securing apparatus may be removably attached thereto.

Once the securing apparatus is attached to the object, the securing apparatus may permit a user to secure the object and/or other objects using several possible techniques. For example, the main body of the securing apparatus may include eyelets configured to receive a length of filament therethrough, such that the filament may be threaded through multiple adjacent securing apparatuses to couple multiple objects together during packaging and shipping. Additionally, the securing apparatus may include a finger portion that is configured to retain a portion of filament that may be used to secure the object to a pallet or other structure for shipping. A user may secure the object via the securing apparatus using these techniques either alone or in combination with one another. So configured, the securing apparatus permits a user to secure the object using various methods and to protect and reinforce the covered portion of the object by inhibiting any deformation or scratches thereto that may occur during, for example, shipping.

Figure 1:
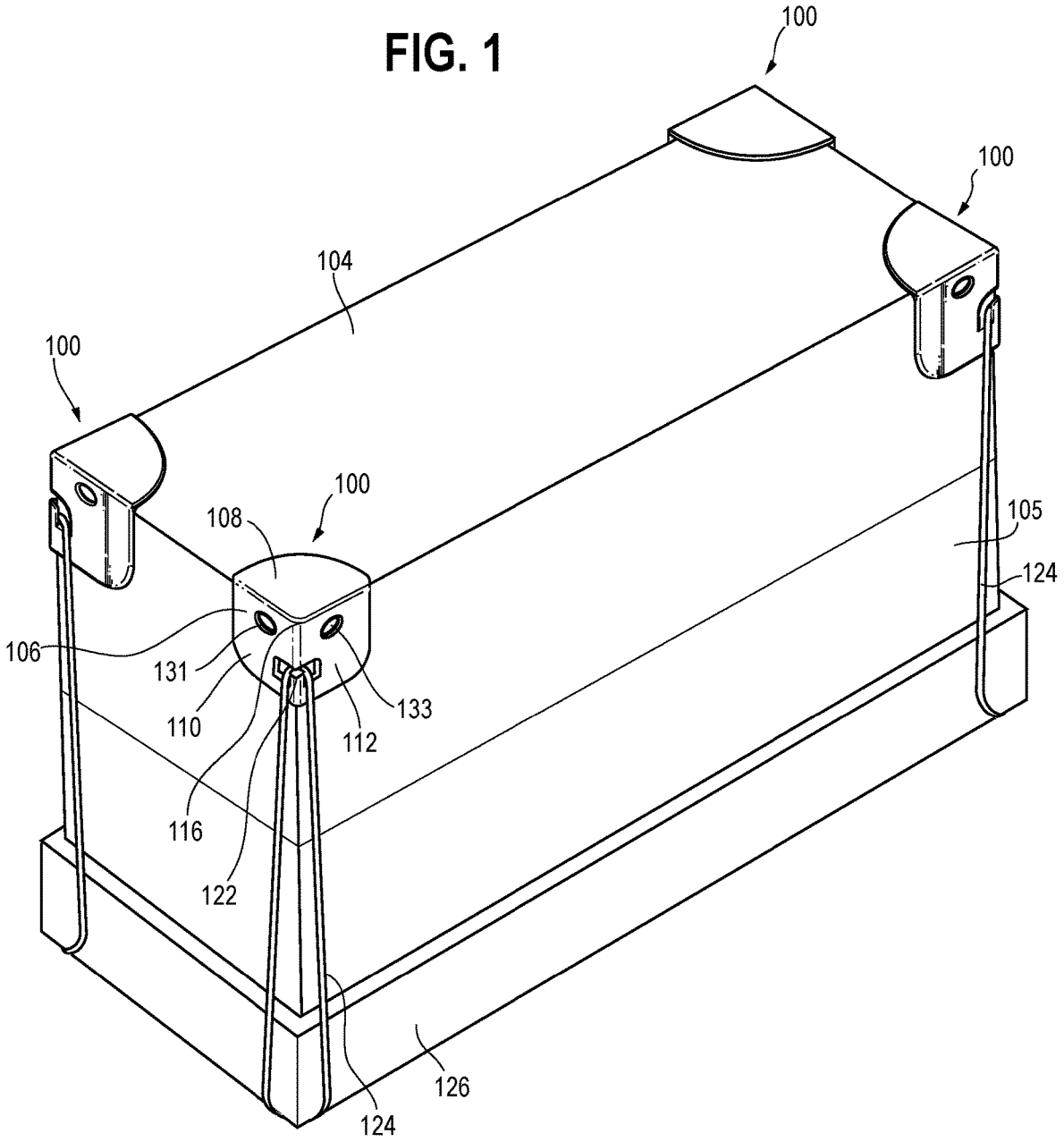
FIG. 1 is a perspective view of multiple objects secured to a pallet using a plurality of example securing apparatuses in accordance with one embodiment of the present disclosure.

Referring now to the drawings, and more particularly FIG. 1, four example securing apparatuses 100 are shown attached to, and partially covering, four corner portions 102 (FIG. 2) of an object 104 that is intended to be shipped. The object 104 is shown stacked above another, similar object 105 on top of a pallet 126. In the illustrated form, each securing apparatus 100 includes a main body 106 having a first wall portion 108, a second wall portion 110, and a third wall portion 112 that each intersect with one another in a generally orthogonal manner. This intersection of the first, second, and third wall portions 108, 110, 112 defines an at least partially hollow cavity that generally corresponds to and is configured to receive a corner portion 102 of an object 104. As shown, each securing apparatus 100 is positioned on the object 104 in such a way that an apex 114 (FIG. 2) of the corner portion 102 of the object 104 is positioned proximate an apex 116 of an intersection of the first wall portion 108, the second wall portion 110, and the third wall portion 112. So configured, each of the first, second, and third wall portions 108, 110, 112 may be superimposed over a different side surface of the object 104 when the securing apparatus 100 is attached thereto, and the main body 106 is held closely adjacent to or abutting the side surfaces of the object 104. In other forms, the securing apparatus 100 may be positioned such that there is at least some amount of space between the wall portions 108, 110, 112 of the main body 106 and the underlying surfaces of the object 104.

The securing apparatus 100 may include at least one anchor 118 (FIG. 3) that is configured to facilitate the selective attachment of the securing apparatus 100 to the object 104. In one aspect, the anchor 118 may be formed as a pointed projection or spike 120 that is configured to pierce or penetrate the surface of the object 104 so as to be resiliently embedded therein as described in further detail below. Once the user desires to remove the securing apparatus 100 from the corner portion 102 of the object 104, the user may detach the securing apparatus 100 by disengaging the anchor 118 therefrom. The user may then discard the securing apparatus 100 in single-use applications or may reuse the securing apparatus 100 as desired for further packaging and shipping.

Figure 2:
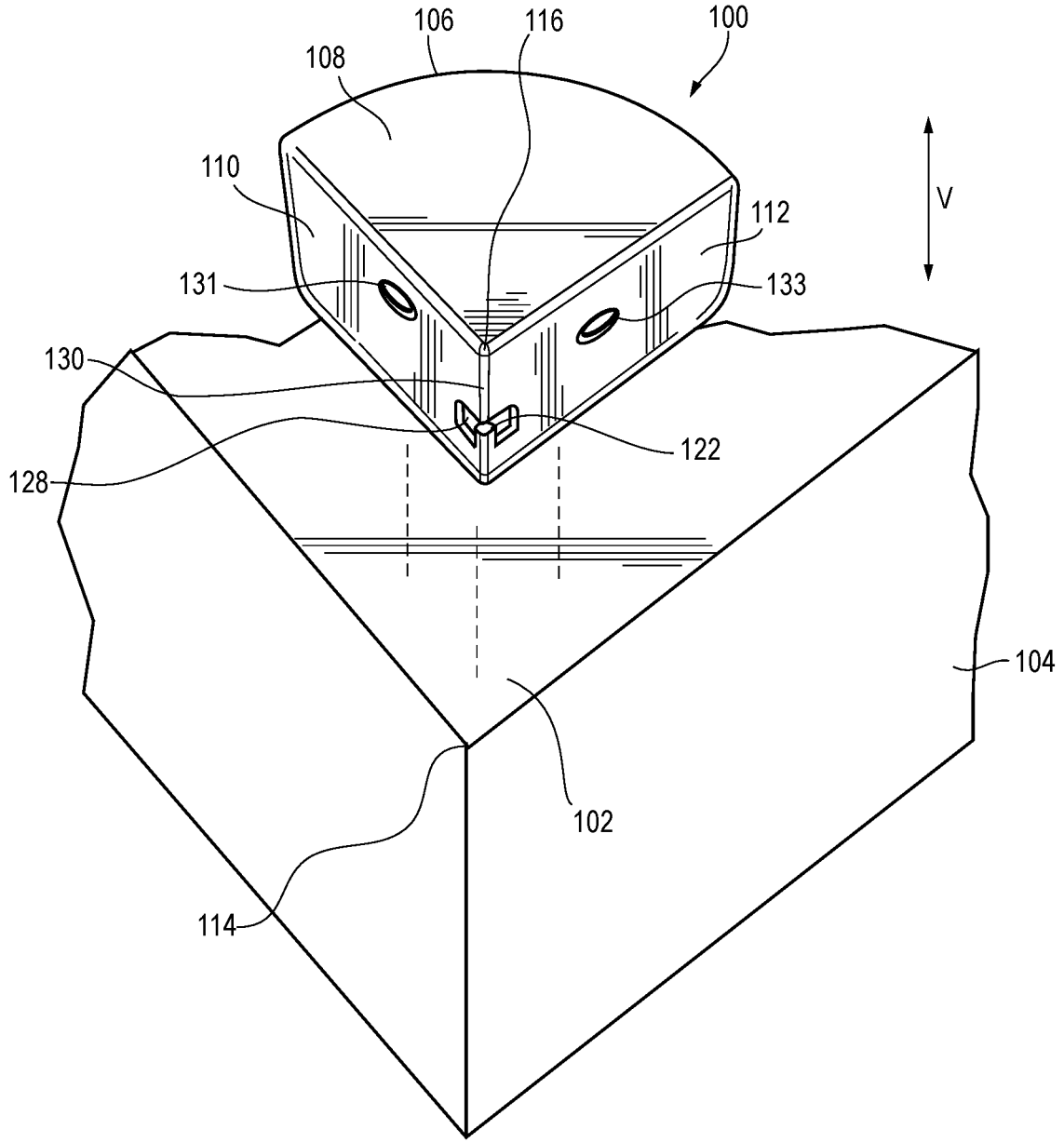
FIG. 2 is an enlarged, partially exploded view of FIG. 1 showing the securing apparatus having a main body with a projecting finger and eyelet openings.

As illustrated in FIGS. 1 and 2, the main body 106 includes a projecting finger 122 that is configured to receive a portion or length of filament 124 such that the filament 124 may be used to more securely attach the object 104 (and any other objects stacked below) to a delivery structure, such as a pallet 126. In the context of the present disclosure, the filament 124 should be understood to encompass any form of string, rope, wire, strapping, stretch wrap string, twine, cord, cable, elastic bands, or other similar rope-like structures that may be used to tie an object to a delivery structure. In one aspect, the projecting finger 122 may be formed integral with the main body 106 and be defined by an upside-down U-shaped opening 128 that extends across a junction 130 between the second wall portion 110 and the third wall portion 112. In such forms, the U-shaped opening 128 defines an integral projecting finger 122 extending upward in the vertical direction V that the filament 124 may be at least partially wrapped or looped around. In other forms, the projecting finger 122 may be formed as a separate component that may be attached to the main body 106 or may be formed in or on other portions of the main body 106 as long as the projecting finger is configured to retain a portion of filament 124.

Once the securing apparatus 100 has been attached to the corner portion 102 of the object 104, the user may select a filament 124, such as a string, and weave or loop the filament 124 around the projecting finger 122 of the main body 106 such that the filament 124 may be retained thereon as shown in FIG. 1. Then, the user may secure the filament 124 to a portion of the pallet 126 on which the object 104 is placed by tying the filament 124 to either a corner of the pallet 126 or a hook or other known structure. In some forms, the user may wrap multiple passes of the filament 124 around the projecting finger 122 to more securely stabilize the object 104 and any other objects stacked below. In still other forms, the user may use multiple securing apparatuses 100 in conjunction with one another. For example, the user may tie a first end of the filament 124 to one corner of a pallet, loop the filament 124 around the projecting finger 122 of a first securing apparatus 100, loop the filament 124 around the projecting finger 122 of an adjacent, second securing apparatus 100 that may be attached to another corner portion of the object, and tie the filament 124 to another corner of the pallet. So configured, a user may secure the object in various selected fashions using the projecting fingers 122 of securing apparatuses 100.

Additionally, the main body 106 of the securing apparatus 100 may include one or more eyelets 131, 133 configured to receive a length of filament 124 therethrough such that multiple objects may be threaded and secured to one another during packaging and shipping using multiple securing apparatuses 100, as described in further detail below with respect to FIGS. 3, 4, and 12-14.

The securing apparatus 100 may formed of an environmentally friendly material that is either recyclable or biodegradable to reduce the waste involved in the packaging and shipping process. For example, the main body 106 of the securing apparatus 100 may be formed of a corrugated cardboard material or a polymer such that the securing apparatus 100 may be recycled after one or more uses. Alternatively, the securing apparatus 100 may be formed of a biodegradable material such as bamboo resin, a composite including bamboo resin, other plant-based composites or materials, or a biodegradable plastic. In some embodiments, the main body 106 of the securing apparatus 100 may be formed of a unitary monolithic construction.

Although the main body 106 of the securing apparatus 100 is described as including first, second, and third wall portions 108, 110, 112, it should be understood that the securing apparatus 100 may also include additional, or fewer wall portions in order to accommodate objects that may be of an irregular shape, e.g., objects that do not have a defined "corner" such as a box. In some examples, wall portions of the securing apparatus 100 may be structured (e.g., rounded or connected in different angles) to interface with objects having irregular edges, such as a rounded edge, and still function in a similar manner to secure the object during shipping and inhibit damage to the object during transit. Similarly, the size of the securing apparatus 100 may be adjusted to fit different objects to be shipped having various sizes. In some forms, one or more of the first wall portion 108, the second wall portion 110, and the third wall portion 112 may be elongated to cover a larger portion of an edge of the object 104, and the first wall portion 108, second wall portion 110, and third wall portion 112 need not be the same size.

Referring again to FIG. 2, the securing apparatus 100 is positioned above the corner portion 102 of the object 104 and is ready to be attached thereto. From this position, a user may advance the securing apparatus 100 downward in the vertical direction V, and apply a force thereto in order to cause the anchor 118 (FIG. 3) of the securing apparatus 100 to pierce and embed itself into the surface of the object 104 so as to removably attach the securing apparatus 100 thereto. Once the securing apparatus 100 is attached, the first, second and third wall portions 108, 110, 112 are superimposed over respective side surfaces of the object 104. If the user desires to subsequently remove the securing apparatus 100 from the object 104, the user may pull or push the securing apparatus 100 upward in the vertical direction V such that the anchor 118 disengages the object 104.

Figure 3:
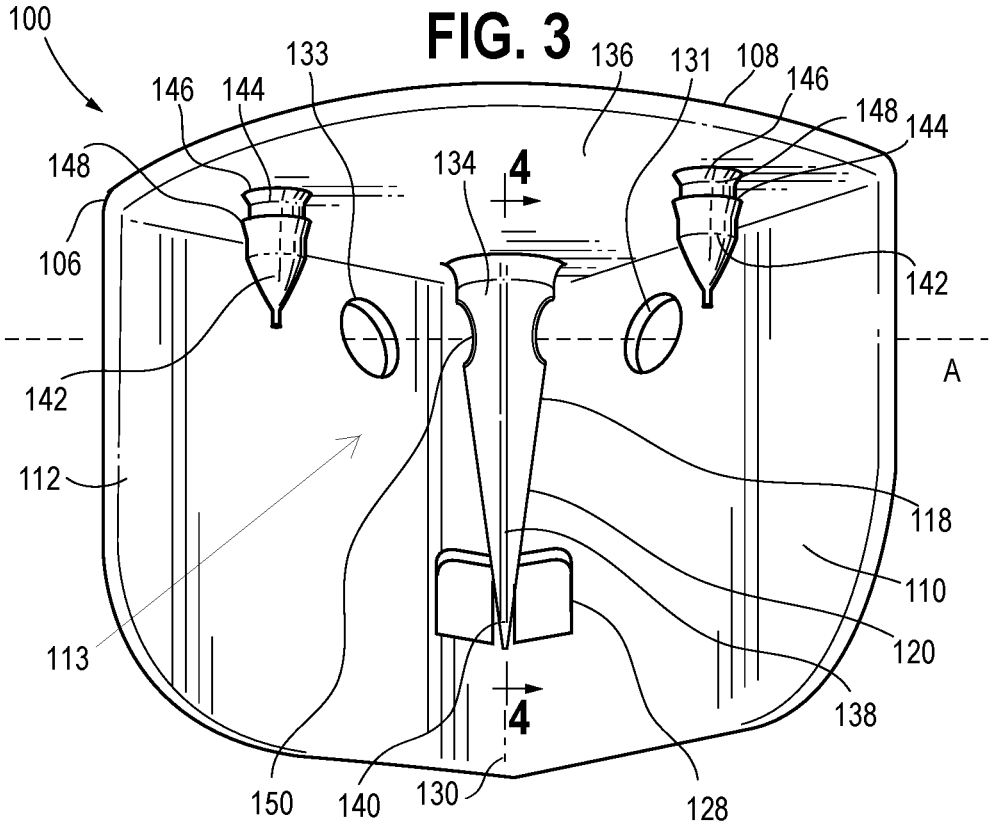
FIG. 3 is a perspective view from below the securing apparatus of FIG. 2 showing inner surfaces of the main body, an anchor having a through-hole, and two secondary anchors.

With respect to FIG. 3, an opposite, inner side of the securing apparatus 100 is shown illustrating inner surfaces of the main body 106. As shown, the orthogonal intersection of the first, second, and third wall portions 108, 110, 112 defines the at least partially hollow cavity 113 that is sized to receive a corner portion 102 of an object 104, such as a box.

In one example, the at least one anchor 118 is formed as a spike or stake-like protrusion having a proximal portion 134 that extends from an inner surface 136 of the first wall portion 108 and a distal portion 138 that terminates in a tip 140. The narrowed tip 140 of the anchor 118 may facilitate effective piercing of the surface of the object to secure the main body 106 thereto. In some forms, the anchor 118 may be formed of a length that is at least about 50% to about 100%, or more particularly, about 80% to about 100%, of the height of the adjacent wall portions 110, 112 to inhibit unintentional removal of the securing apparatus 100 from an object 104 once attached. For example, it may be desirable for the anchor 118 to be of a longer length such that force applied to the main body 106 via tension of the filament 124 tying the projecting finger 122 to a pallet 126 does not inadvertently pull the anchor 118 out of the object 104 such that the main body 106 is disengaged during transit. In some forms, multiple anchors 118 may be provided extending from the main body 106 that are configured to pierce the outer surface of the object. In still other embodiments, such anchors 118 may be positioned to extend from wall portions such as the second and third wall portions 110, 112.

In other forms, the anchor 118 may also include one or more barbs that may be configured to grip into the surface of the object 104 to secure the main body 106 thereto. Such barbs may form the anchor 118 itself or may alternatively be positioned on a surface of the anchor 118 (e.g., spike 120) to further improve the retention of the securing apparatus 100 on the object 104.

The anchor 118 may be spaced from the junction 130 between the second wall portion 110 and the third wall portion 112 to accommodate a thickness of the walls of the object to which the main body 106 is attached. In an example where the object 104 is a cardboard box, the anchor 118 may be spaced from the junction 130 such that the anchor 118 may pierce an upper surface of the cardboard box, and may engage the side surfaces of the box, so as to be held closely adjacent to an inner edge of the cardboard box formed between the side surfaces thereof. In other forms, the anchor 118 may be spaced further from, or closer to, the junction 130.

In some forms, the securing apparatus 100 may also include one or more relatively "smaller" anchors (e.g., in terms of height and/or width) as compared to the anchor 118 to facilitate attachment of the securing apparatus 100, such as barbs or secondary anchors 142, that further improve the stability of the securing apparatus 100 once attached to an object 104 and inhibit unintentional removal therefrom. In addition, the secondary anchors 142 may inhibit shifting of the main body 106 once attached to the object 104. As shown, the secondary anchors 142 likewise extend from the inner surface 136 of the first wall portion 108. In some forms, the secondary anchors 142 may include a reduced width or diameter portion 144 adjacent a proximal portion 146 thereof that forms a shoulder 148. Once the secondary anchors 142 have engaged or pierced the surface of an object 104, such as a corrugated cardboard box, the surface of the box may slightly rebound and frictionally abut the reduced diameter portion 144 such that the shoulder 148 formed thereby may inhibit unintentional removal of the securing apparatus 100 via an interference fit. The anchor 118 may likewise include a similar reduced width or diameter portion. Although illustrated extending from the inner surface 136 of the first wall portion 108, it should be understood that such secondary anchors 142 may alternatively extend from the second and/or third wall portions 110, 112, or a combination of all three wall portions 108, 110, 112, to further secure and inhibit movement of the securing apparatus 100 once attached to the object. In some forms, the securing apparatus 100 may include any number of secondary anchors 142 extending from one or a combination of wall portions 108, 110, 112 in the cavity. As illustrated, the secondary anchors 142 are smaller than the anchor 118, but in alternative forms, may be of a similar size as the anchor 118.

Figure 4:
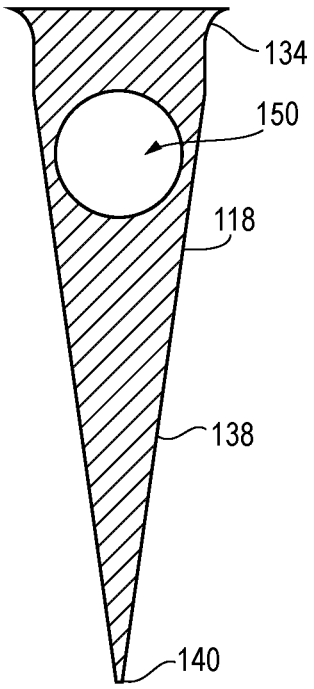
FIG. 4 is a cross-sectional view of the anchor taken across line 4-4 of the securing apparatus of FIG. 3 showing the through-hole thereof.
Figure 5:
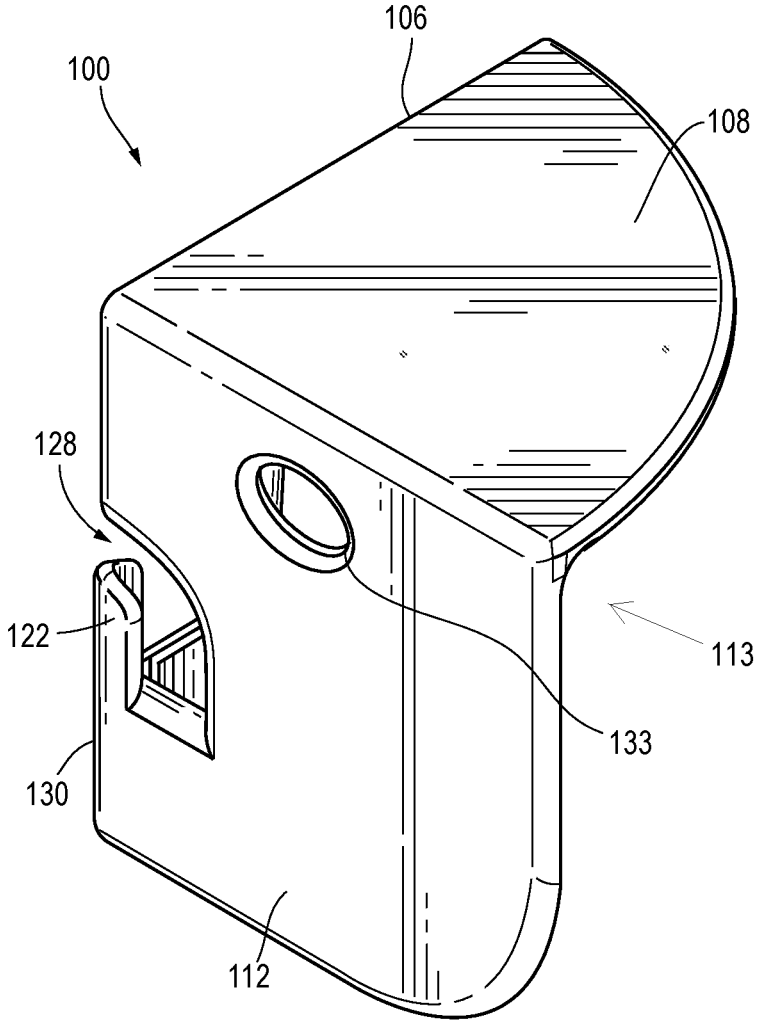
FIG. 5 is a side perspective view of the example securing apparatus of FIG. 2.
Figure 6:
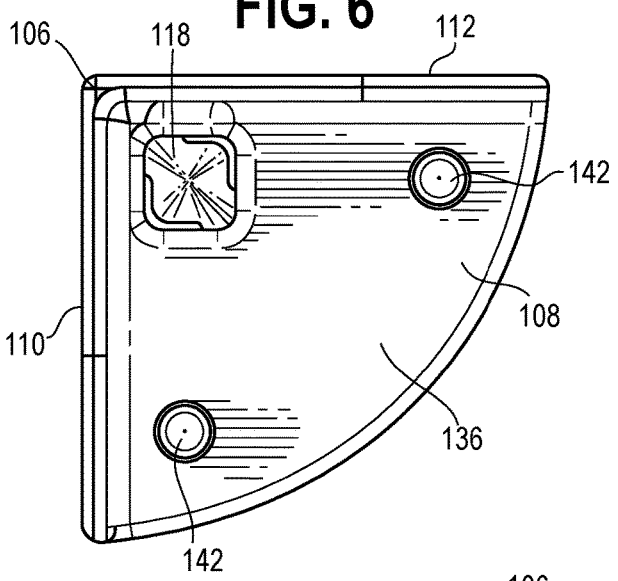
FIG. 6 is a bottom plan view of the example securing apparatus of FIG. 2.
Figure 7:
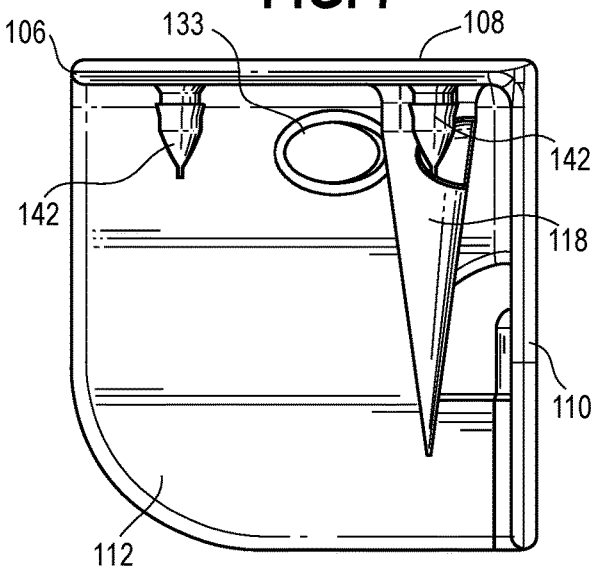
FIG. 7 is a rear view of the example securing apparatus of FIG. 2.
Figure 8:
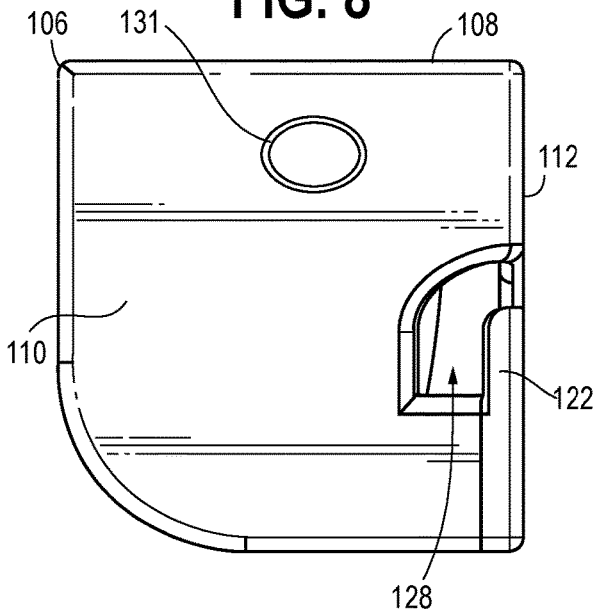
FIG. 8 is a left side view of the example securing apparatus of FIG. 2.
Figure 9:
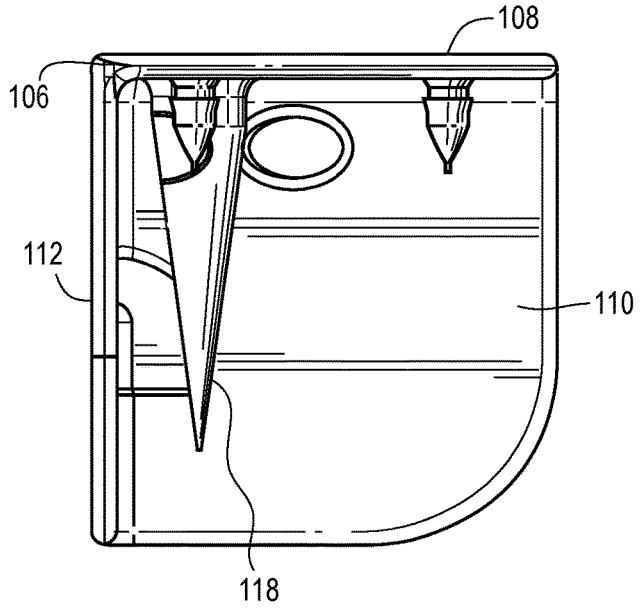
FIG. 9 is a right side view of the example securing apparatus of FIG. 2.
Figure 10:
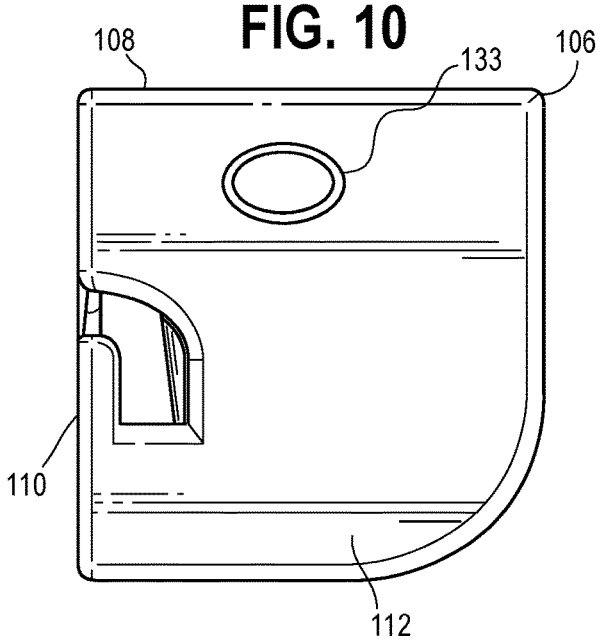
FIG. 10 is front side view of the example securing apparatus of FIG. 2.
Figure 11:
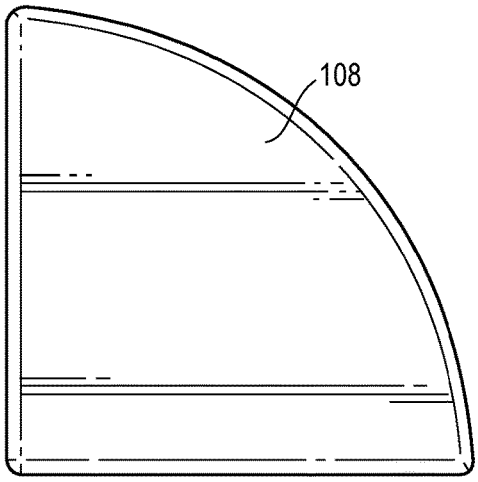
FIG. 11 is a top plan view of the example securing apparatus of FIG. 2.

As shown in FIGS. 3, and 4, the anchor 118 includes a through-hole 150 extending therethrough that is generally aligned along an axis A with the eyelet 131 in the second wall portion 110 and the eyelet 133 in the third wall portion 112. In some forms, the eyelets 131, 133 may be cut or formed in the main body 106 in an angled manner such that the peripheral surface of each eyelet 131, 133 is angled towards the anchor 118 and the eyelets 131, 133 may function to guide a needle and/or filament 124 being advanced therethrough toward the through-hole of the anchor 118. The eyelets 131, 133 and through-hole 150 of the anchor 118 may be used in connection with one another to secure multiple objects together during packaging and shipping using multiple securing apparatuses.

Figure 12:
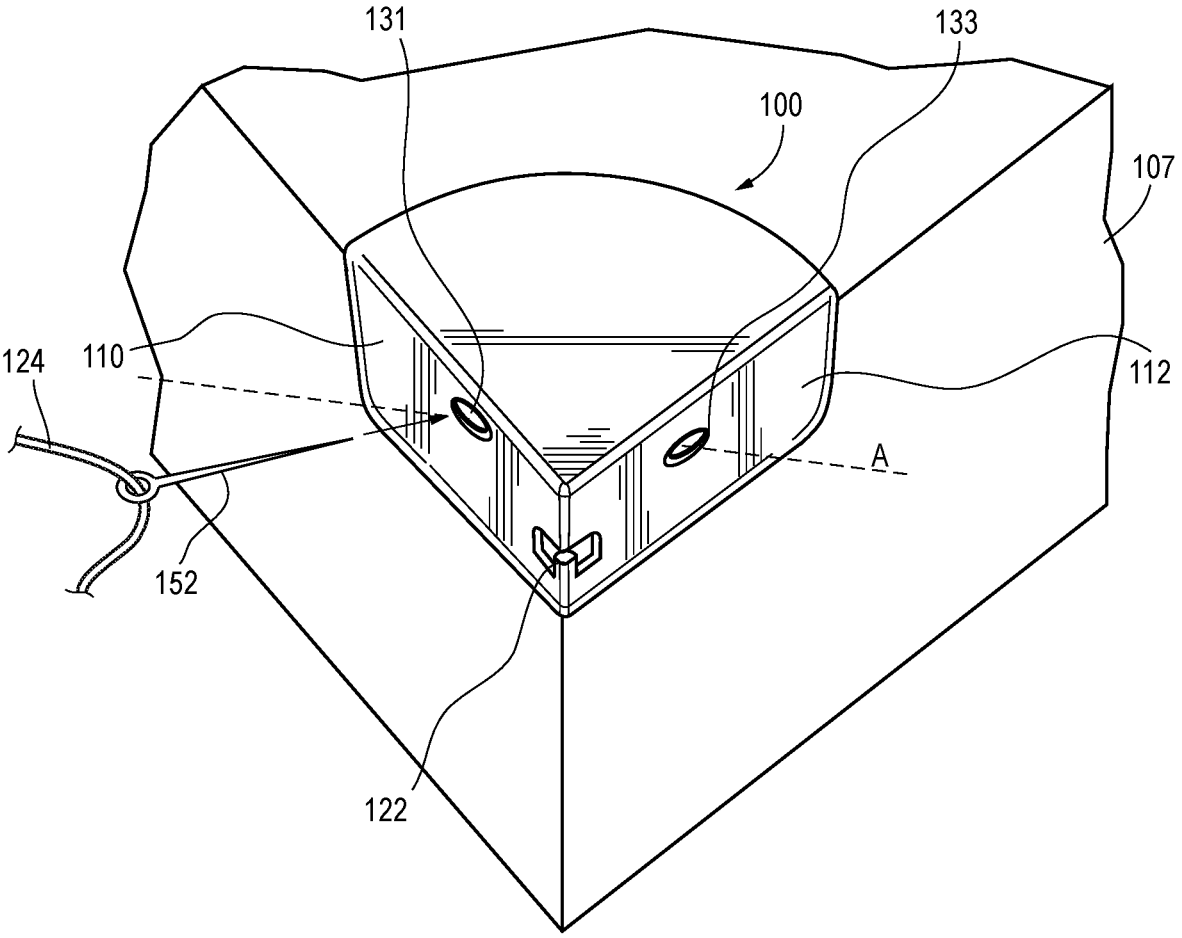
FIG. 12 is a perspective view of an example securing apparatus attached to a corner portion of an object and showing an initial step of using a needle to thread a length of filament through eyelets thereof along an axis A.
Figure 13:
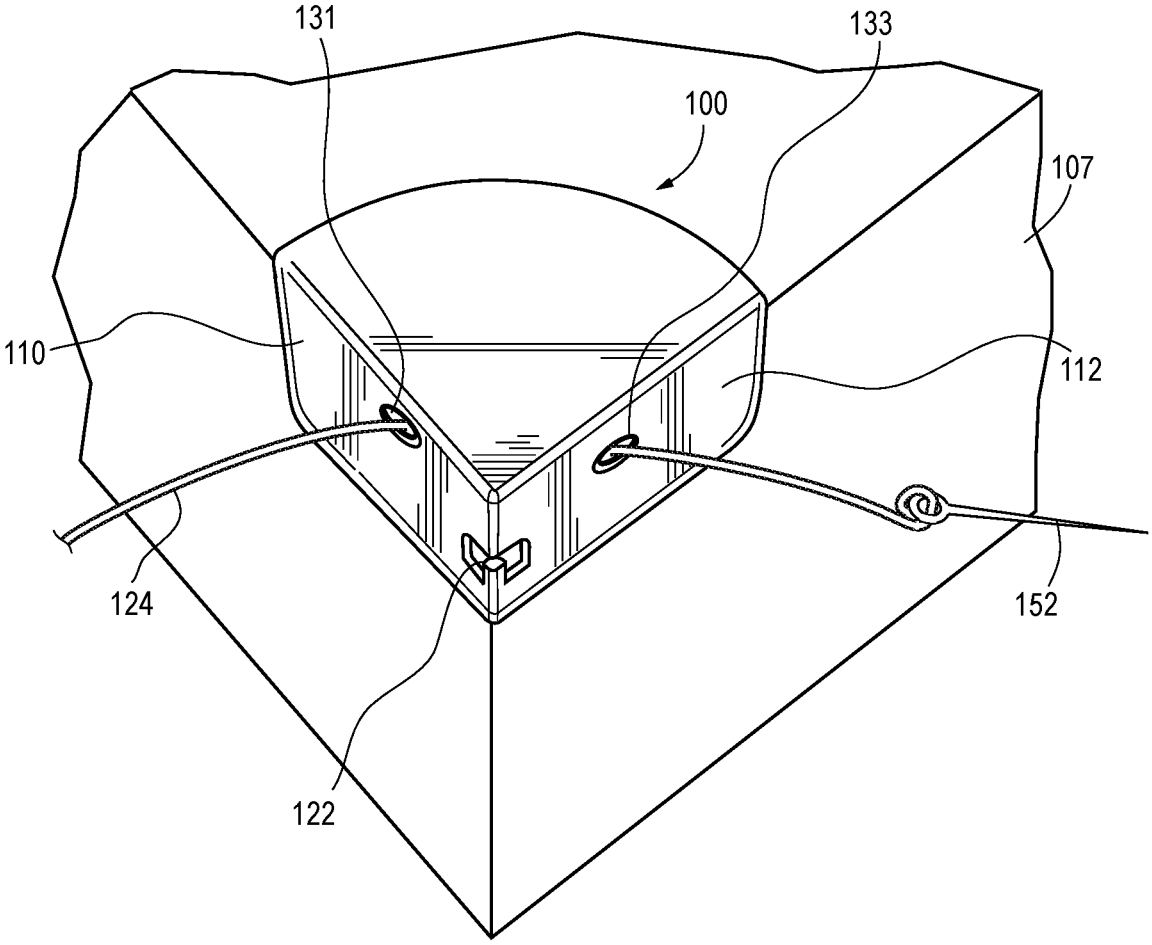
FIG. 13 is a perspective view similar to FIG. 12 showing the filament advanced through both of the eyelets using the needle.
Figure 14:
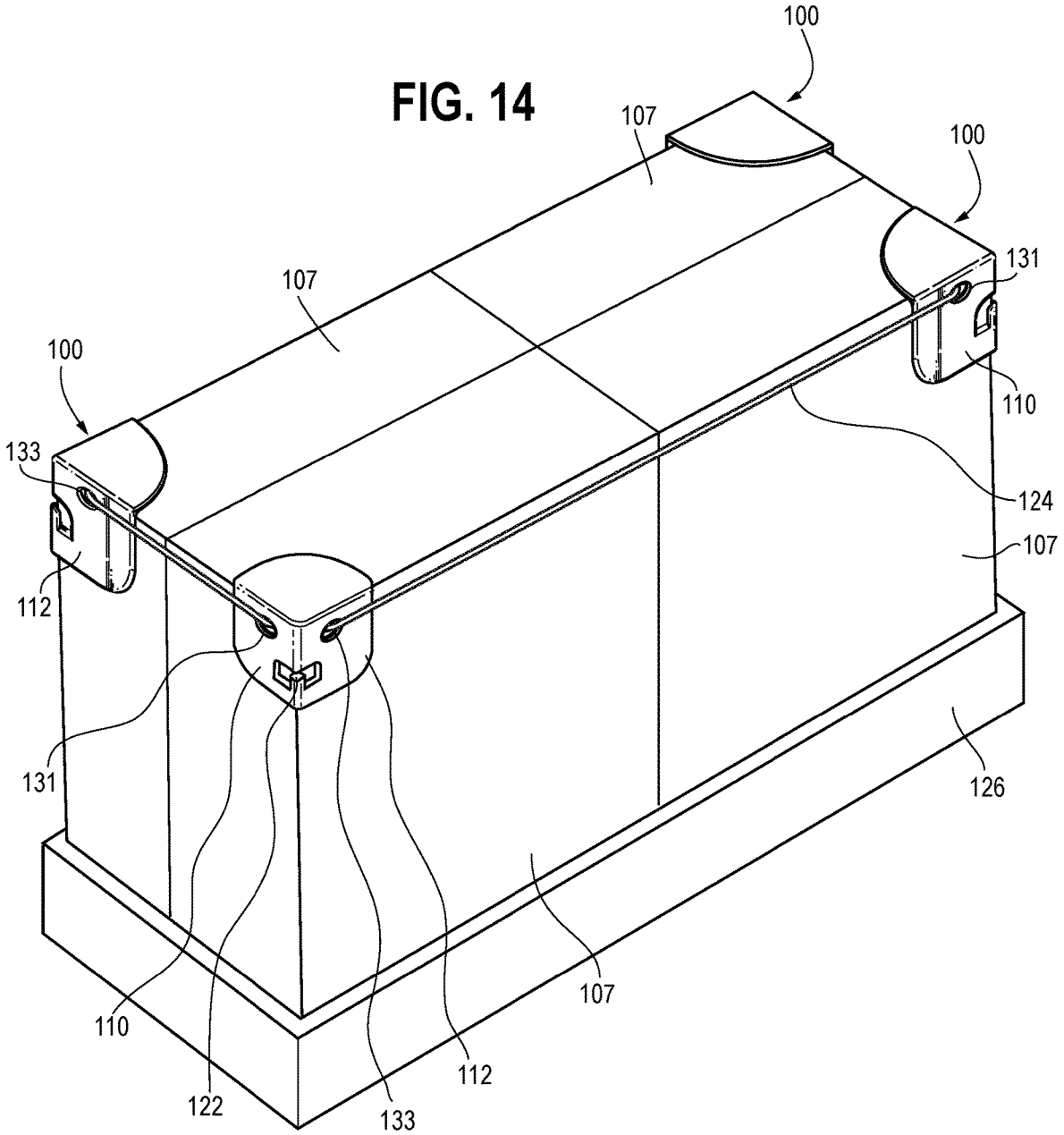
FIG. 14 is a perspective view of a plurality of adjacent objects coupled together on a pallet using a plurality of example securing apparatuses positioned on external corners of the plurality of objects in accordance with one embodiment of the present disclosure.

For example, as shown in FIG. 14, when multiple objects 107 or boxes are placed adjacent one another on a pallet, a user may attach a securing apparatus 100 on each outermost, external corner portion of the grouping of objects as described above. For purposes of the present discussion, objects 107 are substantially similar to objects 104, 105 save the shape and sizing thereof. As shown in FIG. 12 a user may attach a length of filament 124 to a piercing wand or needle 152 and advance the needle 152 towards the eyelet 131 of the second wall portion 110 of the securing device 100. The needle 152 may pierce the side surface of the object 107 over which the second wall portion 110 is superimposed, and the needle 152 may continue to travel along the arbitrary axis A such that it may be advanced through the through-hole 150 of the anchor 118 (see, e.g., FIGS. 3 and 4). Thereafter, as shown in FIG. 13, the needle 152 may continue to advance and pierce the side surface of the object 107 over which the third wall portion 112 is superimposed, through the eyelet 133 thereof, and then the needle 152 may be used to pull the filament 124 through in a sewing-like manner. The user may then repeat this process for each external corner of a grouping of objects and tightly tie the filament 124 either to itself or to another structure such that each of the objects 107 may be held in close proximity during shipping. By using the securing apparatus 100 in this manner, the amount of stretch wrap required to palletize the objects 107 for stable transport may be reduced.

Additionally, or alternatively, the filament 124 threaded through the eyelets 131, 133 and the through-hole 150 of the anchor 118 may be pulled downward and attached to a portion of the pallet 126 by being wrapped around or under various slots thereof. In some forms, multiple lengths of filament 124 may be threaded through the same eyelets 131, 133 and the through-hole 150 of the anchor 118 (or the same filament 124 being threaded through multiple times) and secured to either a portion of the pallet 126 or an adjacent securing apparatus to hold a grouping of objects 107 in close proximity as described above. This in turn may further secure assist in securing the objects during shipping.

In addition to the threading connection between the securing apparatuses 100 shown in FIG. 14, the user may likewise desire to attach the securing device 100 on each external corner to the pallet 126 in the manner described above with respect to FIG. 1, i.e., by wrapping filament 124 around the protruding finger 122 of each securing device 100 and tying the filament 124 to a portion of the pallet 126 so as to reduce the amount of strapping required to palletize the objects for stable transport. In some forms, the user may use the same filament 124 for both methods of securing the objects to the pallet or may use different filament. So configured, the securing techniques provided by the securing apparatus may be used to securely package or palletize objects and may reduce the use of both stretch wrap and strapping in the shipping process.

Referring now to FIGS. 5-11, various views of an example securing apparatus 100 are shown illustrating various aspects thereof.

While there have been illustrated and described particular embodiments, it will be appreciated that numerous changes and modifications will occur to those skilled in the art, and it is intended for the present disclosure to cover all those changes and modifications which fall within the scope of the appended claims. For example, although the securing apparatus described herein are primarily shown attached to upper corner portions and surfaces of objects by advancing the anchor of the main body downward and embedding itself in the surface of the object, it should be appreciated that such securing apparatuses may likewise be attached to the lower corner portions of an object as well. This in turn may permit a user to tie upper and lower corner portions of a palletized grouping of objects together via the projecting fingers of multiple securing apparatuses attached at both an upper external corner of the objects and a lower external corner of the objects.

What is claimed is:

1. A securing apparatus for use in packaging and shipping, the securing apparatus comprising:

a main body having a cavity configured to be received over a portion of an object, wherein the main body further includes two or more eyelets configured to receive a second length of filament therethrough;

at least one anchor extending from the main body in the cavity and connected to move with the main body and the cavity regardless of a position of the main body relative to the object, the at least one anchor configured to pierce through a surface of the portion of the object when the main body is pushed onto the object, wherein the at least one anchor includes a transverse through-hole which is aligned with at least two of the two or more eyelets; and a projecting finger extending from the main body and configured to retain a length of filament for securing the object.

2. The securing apparatus of claim 1, wherein the projecting finger is defined by a U-shaped opening formed in the main body.

3. The securing apparatus of claim 1, further comprising one or more secondary anchors extending from the main body configured to engage with, and be removably attached to, the surface of the portion of the object.

4. The securing apparatus of claim 1, wherein the main body is formed of bamboo resin.

5. The securing apparatus of claim 1, wherein the at least two or more eyelets are disposed on consecutive walls of the main body.

6. The securing apparatus of claim 3, wherein at least one of the one or more secondary anchors extends perpendicular to the at least one anchor.

7. A securing apparatus for use in packaging and shipping, the securing apparatus comprising:

a main body including a first wall portion, a second wall portion, and a third wall portion, the first, second, and third wall portions intersecting to define a cavity of the main body configured to engage a corner portion of an object;

at least one anchor extending from the first wall portion in the cavity and having a transverse through-hole, the at least one anchor configured to penetrate into the object;

wherein the main body further includes a pair of eyelets in consecutive wall portions and aligned with the transverse through-hole to allow a length of filament to be advanced through one of the pair of eyelets, through the transverse through-hole of the anchor, and through another one of the pair of eyelets to facilitate attachment of the main body to another structure.

8. The securing apparatus of claim 7, wherein the main body further includes a projecting finger, wherein the projecting finger is configured to retain another length of filament.

9. The securing apparatus of claim 8, wherein the projecting finger is positioned to extend along a junction at least partially between the second wall portion and the third wall portion of the main body.

10. The securing apparatus of claim 7, further comprising one or more secondary anchors extending from the first wall portion in the cavity, the one or more secondary anchors configured to engage a surface of the object.

11. The securing apparatus of claim 7, wherein the first wall portion, the second wall portion, and the third wall portion intersect orthogonally.

12. The securing apparatus of claim 7, wherein the main body is formed of bamboo resin.

13. The securing apparatus of claim 7, wherein the first wall portion, the second wall portion, the third wall portion, and the at least one anchor are of a monolithic construction.

14. The securing apparatus of claim 7, further comprising one or more secondary anchors extending from the second wall portion or the third wall portion in the cavity, the one or more secondary anchors configured to engage a surface of the object.

* * * * *